US005652400A

United States Patent [19]

Fujimori et al.

[11] Patent Number: 5,652,400

[45] Date of Patent: Jul. 29, 1997

[54] NETWORK SYSTEM OF MUSICAL EQUIPMENTS WITH MESSAGE ERROR CHECK AND REMOTE STATUS CHECK

[75] Inventors: Junichi Fujimori; Tatsutoshi Abe, both of Hamamatsu, Japan

[73] Assignee: Yamaha Corporation, Japan

[21] Appl. No.: 511,691

[22] Filed: Aug. 7, 1995

[30] Foreign Application Priority Data

Aug. 12, 1994 [JP] Japan ..... 6-210742

[51] Int. Cl.[6] ..... G10H 1/00

[52] U.S. Cl. ..... 84/600; 84/645

[58] Field of Search ..... 84/600–602, 645

[56] References Cited

U.S. PATENT DOCUMENTS

| | | | |
|---|---|---|---|
| 4,412,470 | 11/1983 | Jones | 84/645 |
| 4,922,794 | 5/1990 | Shibukawa | 84/601 |
| 5,119,710 | 6/1992 | Tsurumi et al. | 84/601 X |
| 5,129,302 | 7/1992 | Nishikawa et al. | 84/601 |
| 5,389,729 | 2/1995 | Hiramatsu | 84/601 |

*Primary Examiner*—Stanley J. Witkowski

*Attorney, Agent, or Firm*—Graham & James LLP

[57] ABSTRACT

A musical network system has a plurality of musical equipments interconnected to each other through a communication network which circulates a control message for producing a musical sound. One musical equipment has a transmitter for transmitting a control message to the communication network. Another musical equipment has a receiver for receiving the control message from the communication network. An internal tone generator operates according to the received control message for producing a musical sound. A detector detects whether the received control message is a right one which may not disturb operation of the generator means or a wrong one which may disturb operation of the generator means. A transmitter returns an error message to the one musical equipment through the communication network when the detector detects that the received control message is the wrong one. Further, a receiver of the one musical equipment receives from the communication network status information which is returned by another musical equipment, and checks the returned status information to detect if mis-operation has occurred in another musical equipment for initiating recovery of the mis-operation.

7 Claims, 16 Drawing Sheets

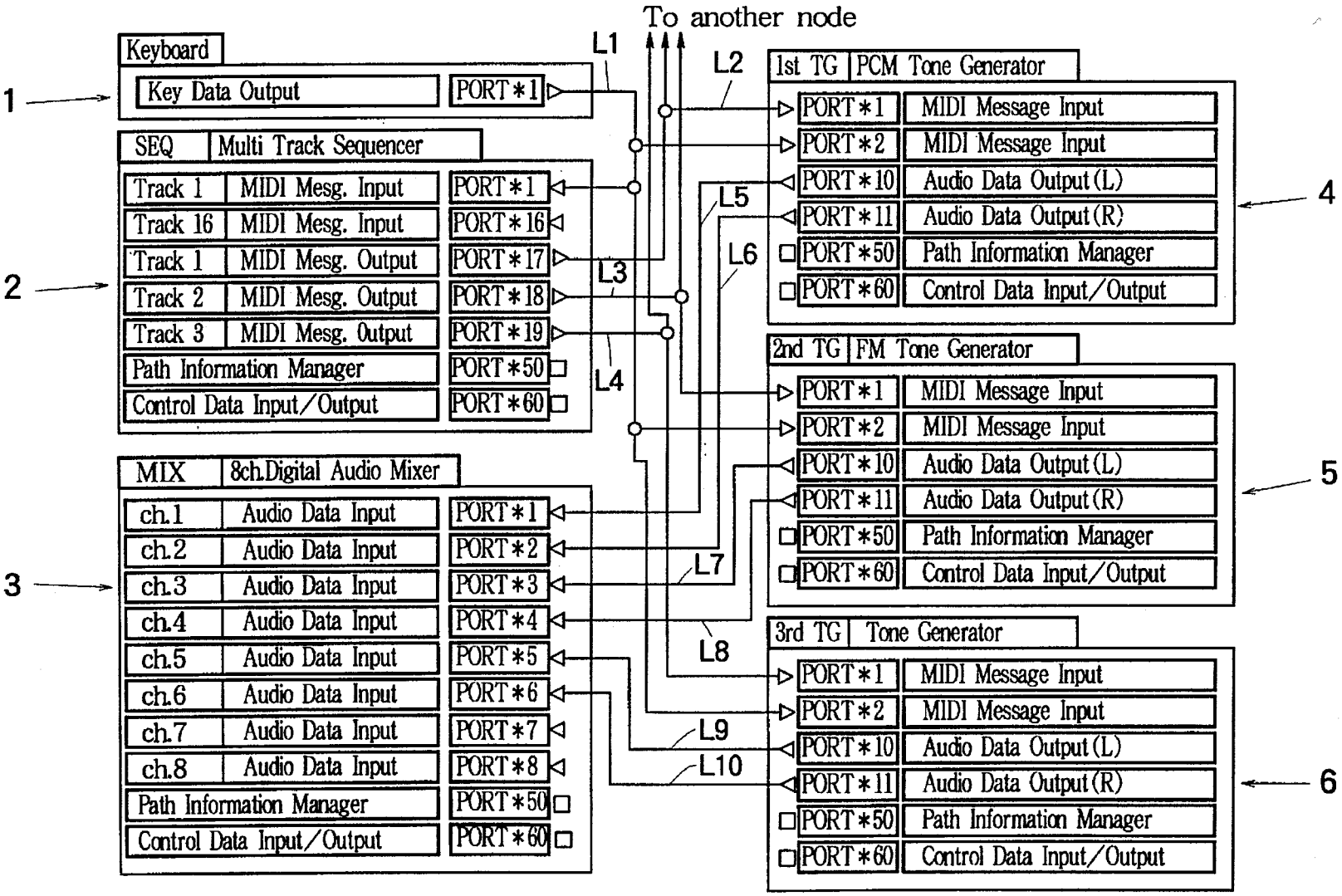
FIG. 1
To another node
L1
L2
L3
L4
L5
L6
L7
L8
L9
L10
1
2
3
4
5
6
Keyboard
Key Data Output
PORT*1
SEQ
Multi Track Sequencer
Track 1
Track 16
Track 1
Track 2
Track 3
MIDI Mesg. Input
MIDI Mesg. Input
MIDI Mesg. Output
MIDI Mesg. Output
MIDI Mesg. Output
Path Information Manager
Control Data Input/Output
PORT*1
PORT*16
PORT*17
PORT*18
PORT*19
PORT*50
PORT*60
MIX
8ch.Digital Audio Mixer
ch.1
ch.2
ch.3
ch.4
ch.5
ch.6
ch.7
ch.8
Audio Data Input
Path Information Manager
Control Data Input/Output
PORT*1
PORT*2
PORT*3
PORT*4
PORT*5
PORT*6
PORT*7
PORT*8
PORT*50
PORT*60
1st TG
PCM Tone Generator
2nd TG
FM Tone Generator
3rd TG
Tone Generator
MIDI Message Input
Audio Data Output (L)
Audio Data Output (R)
Path Information Manager
Control Data Input/Output
PORT*1
PORT*2
PORT*10
PORT*11
PORT*50
PORT*60

FIG.5

Node table

| Node No. | Unique address | Function label | Model code |
|---|---|---|---|
| 1 | aaaa.aaaa | MIDI Keyboard | AAAAAAAA |
| 2 | bbbb.bbbb | Multi Track Seqnencer | BBBBBBBB |
| 3 | cccc.cccc | 8ch.Digital Audio Mixer | CCCCCCCC |
| 4 | dddd.dddd | PCM Tone Generator | DDDDDDDD |
| 5 | eeee.eeee | FM Tone Generator | EEEEEEEE |
| 6 | ffff.abcd | Tone Generator | FFFFFFFF |

FIG.6

Multicast table (Sequencer)

| Port No. | Counterpart node No. |
|---|---|
| 17 | 4, 7, 8, 12 |
| 18 | 5, 9, 15, 18 |
| 19 | 6, 10 |

FIG.7

Port information table (Sequencer)

| Port No. | Type | Protocol | Group code | Service item |
|---|---|---|---|---|
| 1 | RX_ONLY | multicast | d | MIDI Mesg. In (Tr.1) |
| : | : | : | : | : |
| 16 | RX_ONLY | multicast | d | MIDI Mesg. In (Tr.16) |
| 17 | TX_ONLY | multicast | 10 | MIDI Mesg. Out (Tr.1) |
| 18 | TX_ONLY | multicast | 11 | MIDI Mesg. Out (Tr.2) |
| 19 | TX_ONLY | multicast | 12 | MIDI Mesg. Out (Tr.3) |
| 50 | TX_AND_RX | transaction | d | Path Info. Manager |
| 60 | TX_AND_RX | transaction | d | Control Data In/Out |

FIG.8

Path management table (Mixer)

| Receiver port No. | Transmitter unique address | Transmitter port No. | Transmitter model code | Path setting status |
|---|---|---|---|---|
| 1 | dddd.dddd | 10 | DDDDDDDD | 1 |
| 2 | dddd.dddd | 11 | DDDDDDDD | 1 |
| 3 | eeee.eeee | 10 | EEEEEEEE | 1 |
| 4 | eeee.eeee | 11 | EEEEEEEE | 1 |
| 5 | ffff.ffff | 10 | FFFFFFFF | 3 |
| 6 | ffff.ffff | 11 | FFFFFFFF | 3 |

FIG. 9

| Path setting status | Connection State |
|---|---|
| 1 | Path established state |
| 2 | Temporary connection state under request |
| 3 | Suspended state |
| 4 | Disconnection state under request |
| 5 | Connection unable state |

FIG. 17A

Send table

| Port No. | Sent message |
|---|---|
| 17 | ALL NOTE OFF |

FIG. 17B

Return table

| Node No. | Status | Reply message |
|---|---|---|
| 4 | 1 | stopped |
| 7 | 0 | —— |
| 8 | 2 | what ? |
| 12 | 1 | stopped |

FIG.18

| Important/ unimportant | Control message | Normal reply message | Abnormal reply message (Example) | Recovery |
|---|---|---|---|---|
| × | KON | assigned | no assign channel | Ignore |
| ○ | KOFF | send KOFF | no KON data | Ignore |
| × | SEQ start | PLAY mode | no SEQ data | Ignore |
| × | SEQ stop | WAIT mode | can' t STOP | Re-transmit compulsive stop command |
| ○ | TONE change | changed | no such tone data | Make and re-transmit another timbre data |
| × | EFFECT change | changed | no such effect data | Make and re-transmit another effect data |
| ○ | ALL NOTE OFF | stopped | what? | Reset network after confirmation |

NETWORK SYSTEM OF MUSICAL EQUIPMENTS WITH MESSAGE ERROR CHECK AND REMOTE STATUS CHECK

BACKGROUND OF THE INVENTION

The present invention relates to a network system comprised of a plurality of electronic musical equipments, which are set up on a communication network, and which are interconnected to each other by logical paths.

Generally, a plurality of electronic musical instruments can be mutually connected to construct a network system by means of Musical Instrument Digital Interface (MIDI). The MIDI is a standard interface accepted worldwide. The electronic musical instrument can transmit a musical message containing performance information from an internal MIDI terminal according to the MIDI standard. In one application of the MIDI, a single player can concurrently operate a multiple of electronic musical instruments on a stage or else to perform a concert.

However, the MIDI is basically a serial and unidirectional interface. Therefore, a plurality of electronic musical instruments are connected in series by the MIDIs. One instrument only transmits performance information including note-on data and velocity data to another instrument in one way by a serial data format. In order to remove such a drawback, the inventors have proposed a new network system as disclosed in the U.S. patent application Ser. No. 08/388,982 filed Feb. 15, 1995. This new network system is constructed to form a plurality of logical paths in a common communication line to enable bidirectional transfer of musical messages among multiple of electronic musical equipments.

In the proposed network system, the multiple of the electronic musical equipments are distributed throughout a communication network composed of the logical paths. One equipment transmits performance information such as control messages in a sequence of data packets to the communication network. Occasionally, a control message goes astray so that a logical chain of sequential control messages is cut. In such a case, another equipment receives a logically inconsistent control message subsequent to a lost control message. The receipt of the inconsistent or confusing control message may disturb normal operation of the receiving equipment. For example, if a preceding key-on message is lost, the receiving equipment falls into disorder when receiving a succeeding key-off message because the key-off message logically must accompany the key-on message which is actually lost. Further, in case that the logical paths are incorrectly constructed in the communication network, an electronic musical equipment may receive a wrong control message to thereby fall into disorder. Moreover, in case that the transmitting equipment successively transmits control messages at a fast speed over a normal operation speed of the receiving equipment, the operation of the receiving equipment may be seriously disturbed.

SUMMARY OF THE INVENTION

An object of the present invention is to provide a musical network system in which a transmitting equipment can detect if a receiving equipment receives a wrong control message.

Another object of the present invention is to provide a musical network system in which one equipment can remotely recognize change in an operation status of another equipment when the same receives a control message.

In a first aspect of the invention, a musical network system comprises a plurality of musical equipments interconnected to each other through a communication network which circulates a control message for producing a musical sound. One musical equipment comprises transmitter means for transmitting a control message to the communication network. Another musical equipment comprises receiver means for receiving the control message from the communication network, generator means operative according to the received control message for producing a musical sound, detector means for detecting whether the received control message is a right one which may not disturb operation of the generator means or a wrong one which may disturb operation of the generator means, and reply means for returning an error message to said one musical equipment through the communication network when the detector means detects that the received control message is the wrong one. In a specific form, a musical network system comprises a plurality of musical equipments interconnected to each other through a communication network which circulates a musical message for producing a musical sound. One musical equipment comprises transmitter means for transmitting to the communication network musical messages which are classified into either of an important type and an unimportant type, and adder means operative only when a musical message of the important type is transmitted for adding thereto a request command effective to request an error check. Another musical equipment comprises receiver means for receiving a musical message from the communication network, and check means operative when the received musical message is accompanied by the request command for checking if the received musical message contains an error.

In a second aspect of the invention, a musical network system comprises a plurality of musical equipments interconnected to each other through a communication network which circulates a musical message for producing a musical sound. One musical equipment comprises receiver means for receiving a musical message from the communication network, operator means for operating on the received musical message, and reply means for returning to the communication network status information which indicates a current status as a consequence of operation by the operator means. Another musical equipment comprises transmitter means for transmitting to the communication network the musical message which is received by said one musical equipment, receiving means for receiving from the communication network the status information which is returned by said one musical equipment, detector means for checking the returned status information to detect if mis-operation of the operator means has occurred in said one musical equipment, and recovery means for initiating recovery of the mis-operation. In a more general form, a musical network system comprises a plurality of musical equipments interconnected to each other through a communication network which circulates a musical message for producing a musical sound. One musical equipment comprises transmitter means for transmitting a musical message to the communication network. Another musical equipment comprises receiver means for receiving the musical message from the communication network, operator means for operating on the received musical message, and transmitter means for transmitting to the communication network status information which notifies change of a status as a consequence of operation by the operator means.

According to the first aspect of the invention, a receiving equipment returns an error message to a transmitting equipment when receiving a wrong control message. Therefore, the transmitting equipment recognizes an error contained in the control message prepared by the transmitting equipment, or recognizes an error in a communication link. Further, the receiving equipment issues the error message only when receiving the wrong control message, thereby avoiding increase in traffic of the communication network. According to the second aspect of the invention, the receiving equipment returns the status information to notify change in the internal status thereof, which is caused as a result of the receipt of a control message. Therefore, the transmitting equipment recognizes not only that the control message is safely received, but also that the receiving equipment operates on the received control message as expected by the transmitting equipment. Further, when the returned status information indicates mis-operation, the transmitting equipment can readily initiate recovery of the mis-operation. Preferably, the transmitting equipment may request the receiving equipment to return the error message and the status information only for important control messages, thereby avoiding increase in the communication traffic.

BRIEF DESCRIPTION OF DRAWINGS

FIG. 1 is a block diagram showing one embodiment of the inventive network system, which constitutes a complex electronic musical instrument.

FIG. 5 is a table diagram showing a node table of the network system.

FIG. 6 shows an example of a multicast table installed in a sequencer.

FIG. 7 is a table diagram listing port information of one node member composed of a sequencer.

FIG. 8 is a table diagram showing a path management table stored in one node member composed of a mixer.

FIG. 9 is a table diagram listing various path setting statuses.

FIGS. 17A and 17B show a send table and a return table, respectively.

FIG. 18 is a table listing examples of control messages and reply messages.

DETAILED DESCRIPTION OF EMBODIMENTS

Figure 2:
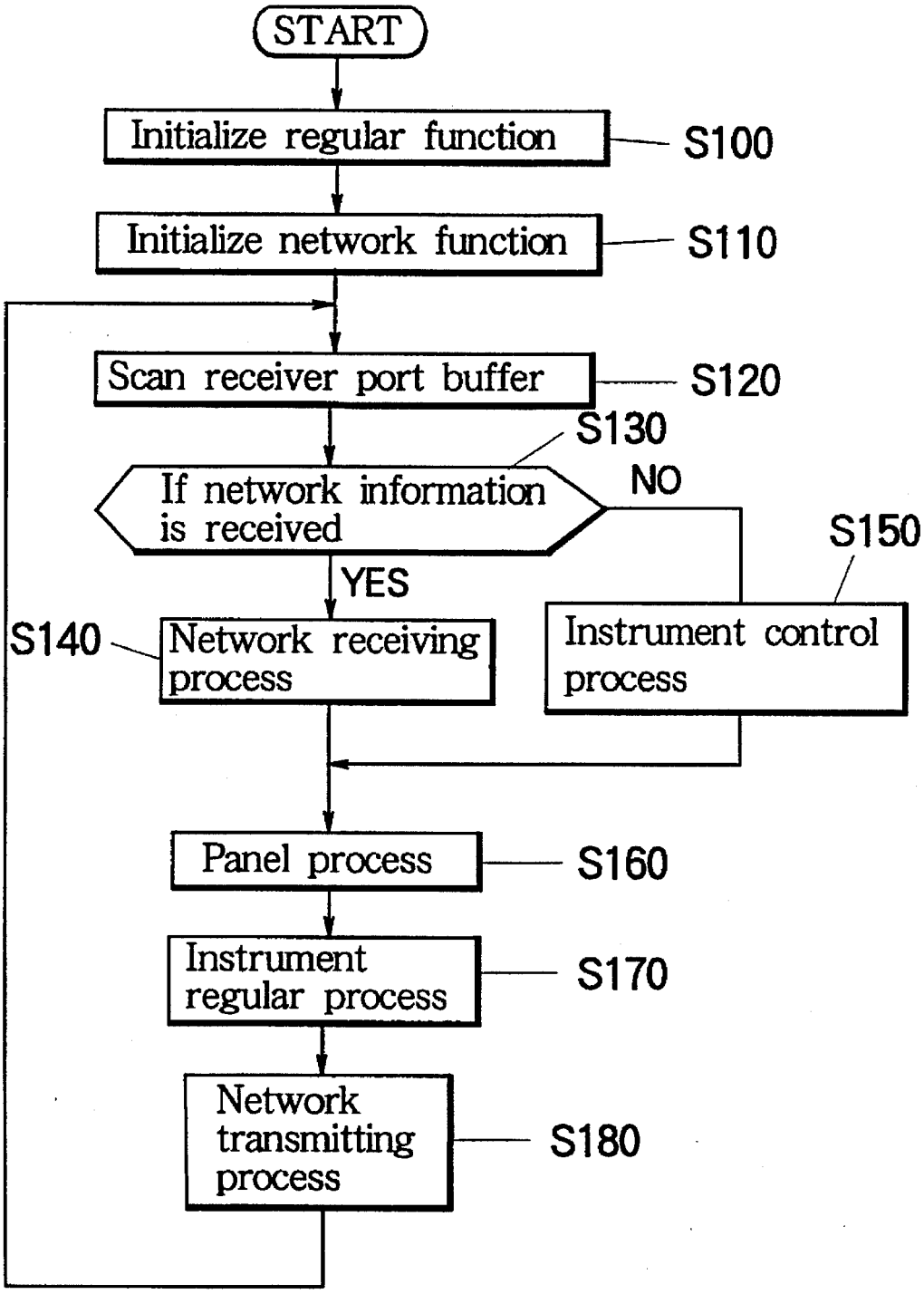
FIG. 2 is a flowchart showing a main routine of the inventive network system.

Referring to FIG. 1, a network system of electronic musical equipments are built up according to the invention. The inventive network system has logical paths indicated by lines L1–L10 which are not physical connection lines, but are virtual connection lines established in the network system.

The network system contains various members 1–6 which are allocated to respective nodes of a network and which have specific functions or roles. In this embodiment, these node members include a keyboard 1, a sequencer (SEQ) 2, a mixer (MIX) 3, a first tone generator (1st TG) 4, a second tone generator (2nd TG) 5 and a third tone generator (3rd TG) 6. The keyboard 1 has a transmitter port *1 for outputting a key code data. The sequencer 2 of multi-track type has an input track 1 and a corresponding receiver port *1 which receives a MIDI message, and an input track 16 and a corresponding receiver port *16 which receives a MIDI message. Though not shown in the figure, the sequencer 2 has input tracks 2–15 and corresponding receiver ports. Further, the sequencer 2 has an output track 1 and a corresponding transmitter port *17 for transmitting a MIDI message, an output track 2 and a corresponding transmitter port *18 for transmitting a MIDI message, and an output track 3 and a corresponding transmitter port *19 for transmitting a MIDI message. Moreover, the sequencer 2 is provided with a path information manager and a corresponding transmitter/receiver port *50, and a controller and a corresponding transmitter/receiver port *60 which transmits a control data output and receives a control data input.

The mixer 3 of eight-channel digital audio type has channels 1–8 and corresponding receiver ports ***1–*8 which receive respective audio data inputs. Further, the mixer 3 is provided with a path information manager and a corresponding transmitter/receiver port *50, and a controller and a corresponding transmitter/receiver port *60** which transmits a control data output and receives a control data input.

The first tone generator 4 of PCM type has a pair of receiver ports *1 and *2 which receive respective MIDI messages. Further, the PCM tone generator 4 has a pair of transmitter ports *10 and *11 which transmit left and right audio data outputs, respectively. Moreover, the PCM tone generator 4 is provided with a path information manager and a corresponding transmitter/receiver port *50, and a controller and a corresponding transmitter/receiver port *60 which transmits a control data output and receives a control data input. On the other hand, the second tone generator 5 is a FM type which has a similar port structure as that of the PCM tone generator 4. The third tone generator 6 may be a PCM type, FM type or else, and has a similar port structure as that of the first tone generator 4. Though not explicitly shown in the figure, these members 1–6 may have additional ports. In these members 1–6, the port is formed and operated by an independent program separately from the remaining functional parts which are operated by an application program.

In the network system composed of the various members 1–6, the logical path L1 is established to connect the transmitter port *1 of the keyboard 1 to those of the receiver port *1 of the sequencer 2, the receiver port *2 of the first tone generator 4, the receiver port *2 of the second tone generator 5 and the receiver port *2 of the third tone generator 6. The logical path L2 connects the transmitter port *17 of the sequencer 2 to the receiver port *1 of the first tone generator 4. The logical path L3 connects the transmitter port *18 of the sequencer 2 to the receiver port *1 of the second tone generator 5. The logical path L4 connects the transmitter port *19 of the sequencer 2 to the receiver port *1 of the third tone generator 6. Further, the logical path L5 connects the transmitter port *10 of the first tone generator 4 to the receiver port *1 of the mixer 3. The logical path L6 connects the transmitter port *11 of the first tone generator 4 to the receiver port *2 of the mixer 3. The logical path L7 connects the transmitter port *10 of the second tone generator 5 to the receiver port *3 of the mixer 3. The logical path L8 connects the transmitter port *11 of the second tone generator 5 to the receiver port *4 of the mixer 3. The logical path L9 connects the transmitter port *10 of the third tone generator 6 to the receiver port *5 of the mixer 3. The last logical path L10 connects the transmitter port *11 of the third tone generator 6 to the receiver port *6 of the mixer 3.

By such a manner, the logical paths L1–L10 interconnect the ports of the members 1–6 with each other to build up the network system. These logical paths are virtual data transfer lines. The logical path is functionally established such that one transmitter port broadcasts a message together with a group code or group address while a multiple of receiver ports assigned the same group address can commonly receive the broadcasted message. Stated otherwise, the multiple of the receiver ports can admit the message which is transmitted to the logical paths from the single transmitter port. More importantly, the logical paths are initially set or programmed by a user to build up the communication network, and logical path information thereof is stored in the receiver port rather than the transmitter port. The initial or original paths can be readily restored at booting or resetting of the system so as to reconstruct the network. Further, the logical path information may be reserved in a portable memory medium such as a floppy disk. The memory medium can be loaded into a specific node member which functions as a network management unit. The logical path information is downloaded into the network management unit so as to construct the network system.

Next, the detailed description is given for operation of the inventive musical network system in conjunction with the flowcharts. FIG. 2 shows a main routine executed by each node member involved in the inventive network system. In the main routine, upon power-on to boot the system, Step S100 is undertaken to initialize its own regular function. For example, in the tone generator node, initialization of the regular function is conducted such as a damp process to prevent generation of an abnormal tone. Then, Step S110 is undertaken to recognize its own node address, to identify other node members, and to conduct an initialization of the network function which will be described later. Further, Step S120 is undertaken to scan its receiver port buffer which receives a message from the network. Subsequently, Step S130 is undertaken to check as to if the received message relates to network information other than performance information. In case of YES, Step S140 is undertaken to admit the network information effective to manage the network operation. In this admission process or receiving process, the node carries out particular network operation to process received messages related to the network matter, which should be treated in an application layer. Further, in this network receiving process, the node checks as to if a counterpart node operates correctly.

In case of NO in Step S130, Step S150 is undertaken to admit the performance information effective to control sounding and silencing operation of the tone generator. In Step S150, the tone generator node conducts instrument control process to perform its regular function. In similar manner, other node members perform their own regular functions in corresponding Steps. After Step S140 or S150 is finished, subsequent Step S160 is undertaken to carry out a panel process such that the user manually sets an operation panel to program logical paths into the network. By this panel process, the respective node member acquires a path management table. Thereafter, the logical paths can be readily reconstructed according to the path management table. Then, Step S170 is undertaken to carry out an instrument regular process such that data and messages are set in a transmission port buffer for external transmission. Further, a confirmation flag is set for important data and messages. Lastly, Step S180 is undertaken to transmit a desired message to the network. The message is transmitted to the network by Step S180 through the port which is virtually formed according to an independent port program. On the other hand, the message itself is produced by an application program, and is fed to the transmitter port. Each node member has a port information table which prescribes a protocol of each port. A transmitter port having a multicast protocol broadcasts the message together with a corresponding group address or group code rather than specifying an individual address of a destined member. Thereafter, the routine returns to Step S120 to thereby repeat the cycle of Steps S120–S180.

Figure 3:
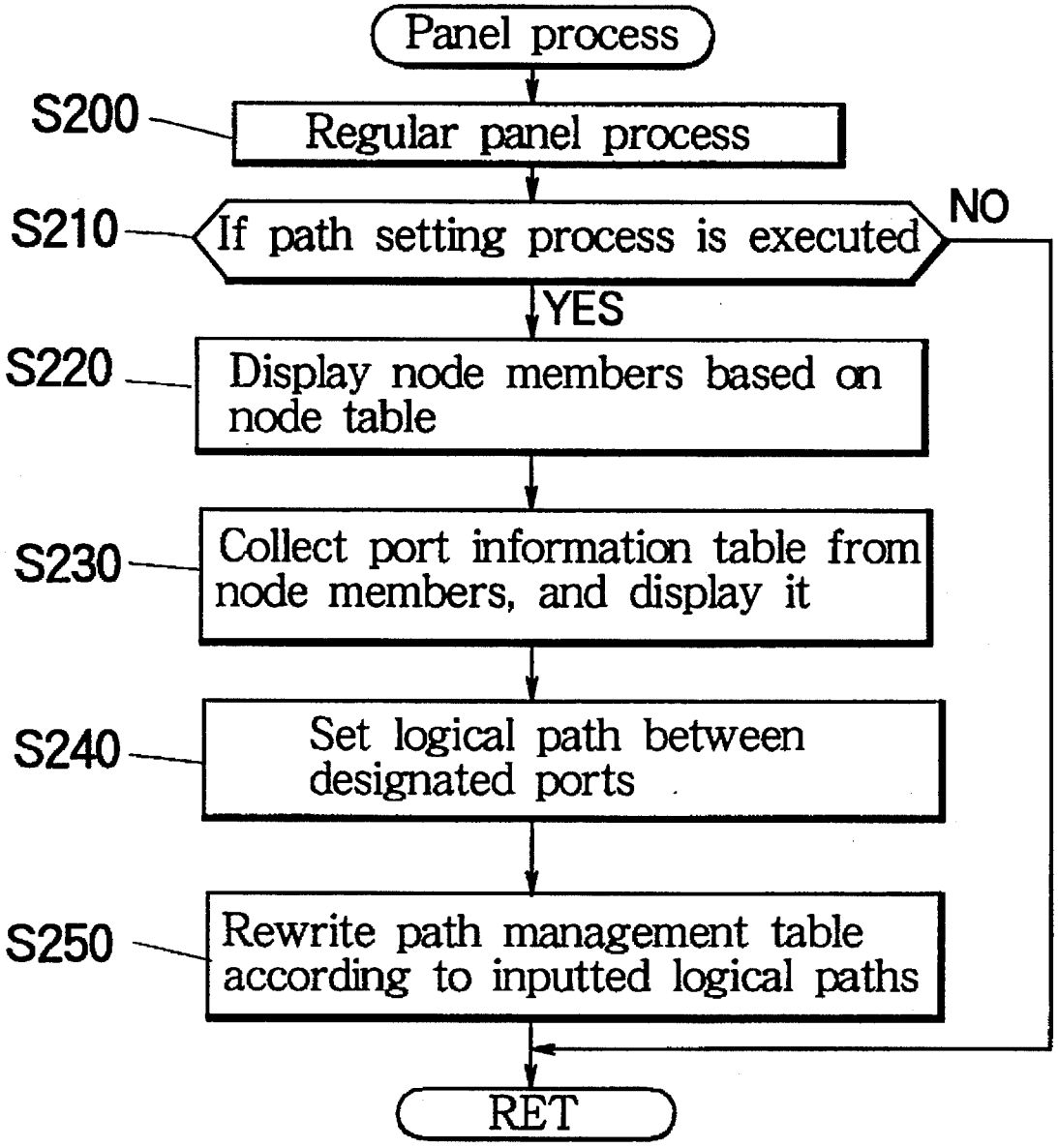
FIG. 3 is a flowchart showing a panel process in the network system.

Next, FIG. 3 shows a detail of the panel process executed in Step S160 of the main routine. This process includes an initial path setting process and a regular panel process. First, Step S200 is undertaken to carry out the regular panel process. Next, Step S210 is undertaken to check as to if a path setting process should be executed. In case of YES, Step S220 is undertaken to display all the node members involved in the network system according to the node table. Further, Step S230 is undertaken to collect individual port information tables from the respective node members, since the node table does not contain any port information. The collected port information is also displayed. Then, Step S240 is undertaken such that the user sets a desired logical path between selected ports while monitoring displayed information. This logical path setting may be conducted such that a single receiver port is connected to multiple transmitter ports while a group code of the transmitter ports is acknowledged and stored by the receiver port. Further, Step S250 is undertaken to rewrite the path management tables based on the inputted logical paths, thereby returning. Also, the routine returns in case that Step S210 judges that the path setting process is not called.

Figure 4:
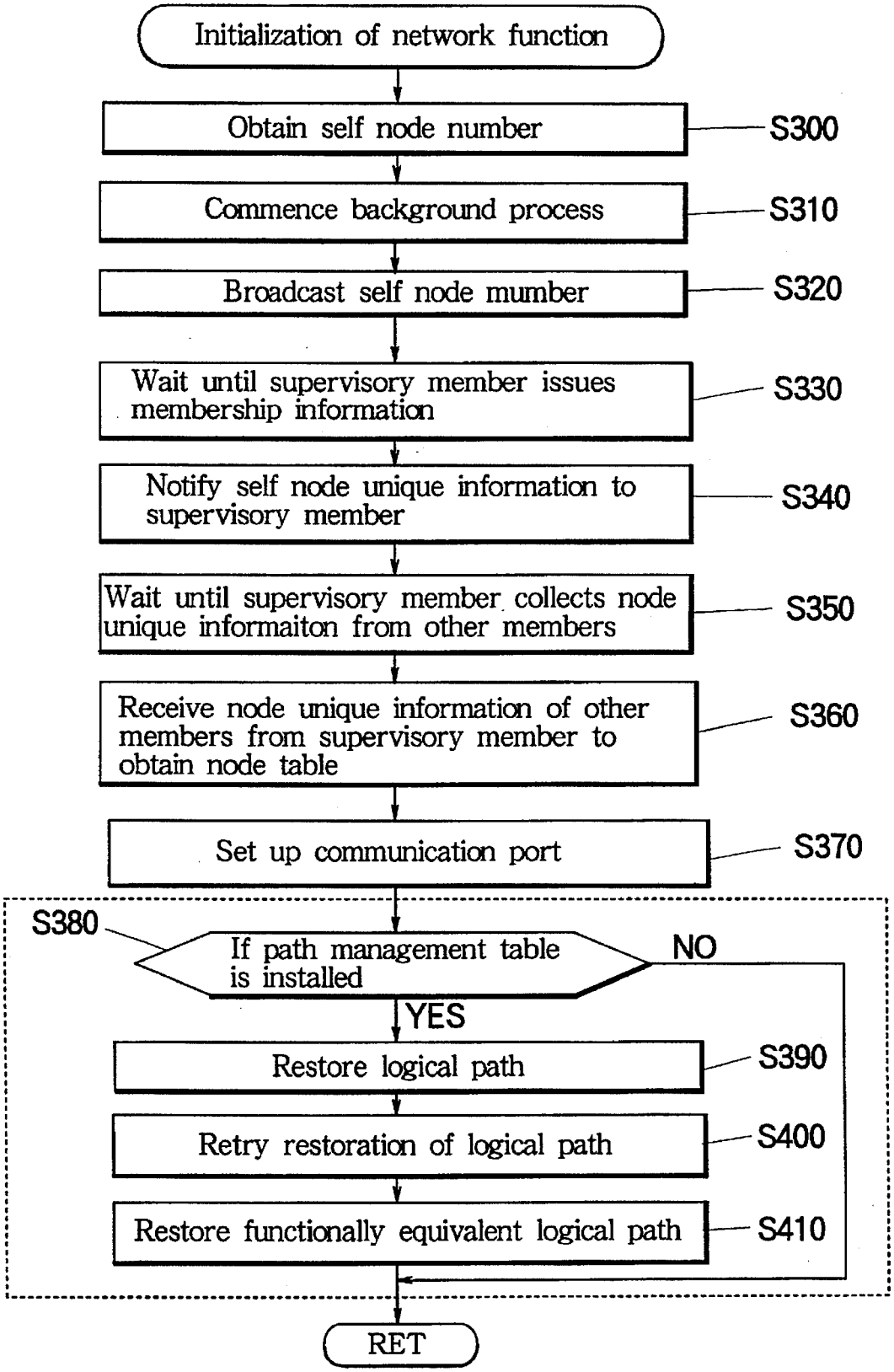
FIG. 4 is a flowchart showing an initialization process of the network system.

Next, FIG. 4 is a flowchart showing the initialization process of the network function executed in Step S110 of the main routine. First, at the start of the initialization process, Step S300 is undertaken when the system is activated so that each node member recognizes its own node number according to a specific algorithm. Then, Step S310 is undertaken to commence a background process which will be described later in detail. Briefly, a supervisory or initiative member is designated in the background process. The designated member watches data packets broadcasted from other members and circulating the network so as to collect node numbers of other members from the data packets. Otherwise, the supervisory member passes the data packets to a higher layer, or performs various tasks in response to a service demand contained in the data packets. In subsequent Step S320, each node member broadcasts its own node number which is recognized at Step S300 to the network. The supervisory member or initiative member collects the broadcasted node number data and records the same. Further, the initiative member recognizes the membership of the network system to thereby broadcast a first ready signal which indicates completion of preparation of membership information. For this, Step S330 is undertaken to stand by until the first ready signal is issued from the initiative member. A relatively nonbusy member is automatically designated as the initiative or supervisory member among all the members involved in the network system according to so designed algorithm.

Then, Step S340 is undertaken upon the issue of the first ready signal which indicates the completion of the preparation of the membership information such that the individual member notifies its own node unique information to the initiative member through the network. The node unique information contains a unique address, a function label and a model code of the individual member. The unique address indicates a unique machine code of an electronic equipment that is the individual member. The function label indicates a performance function of the electronic equipment. The model code indicates a general or higher classification of the electronic equipment. The unique address is specific to a lower class of the electronic equipment, while the model code is generic to lower classes of the electronic equipment having a different structure but an equivalent function.

FIG. 5 shows a node table which lists the node unique information of all the node members. For example, the node member 1 has a unique address "aaaaaaaa", a function label "MIDI KEYBOARD", and a machine model code "AAAAAAAA". The node numbers listed in this node table correspond to the reference numerals of the respective nodes shown in FIG. 1. The initiative node member collects the node unique information from all of the node members to thereby broadcast a second ready signal which indicates completion of the node table. In this regard, Step S350 is undertaken to stand by until the initiative member finishes the collection of all the node unique information. Upon the issue of the second ready signal, Step S360 is undertaken so that each member receives the node unique information of other members from the initiative member to thereby store the node table shown in FIG. 5, which is commonly owned by all the members.

Next, Step S370 is undertaken such that each member forms transmitter and receiver ports according to an installed program. Consequently, for each member, for example, the sequencer node produces a port information table as shown in FIG. 7, which lists a port number, a type of transmitter and/or receiver, a protocol, a group code and a service item. In Step S370, each transmitter port is assigned with a unique group code if the same has the multicast protocol as will be described later in detail. Then, Step S380 is undertaken to check as to if the individual member, for example, the mixer node has its own path management table as shown in FIG. 8. In case of YES, Step S390 is undertaken to restore logical paths according to the path management table. Further, Step S400 is undertaken to retry restoration of the logical paths when Step S390 fails to open the logical paths due to missing data packets or nonresponse from other parties. Further, Step S410 is undertaken when a logical path is not restored even by the retrial of Step S400 so as to connect that logical path to a functionally equivalent node instead of a true node which is not found in the member of the network system, thereby returning. Also, the routine returns in the case where the check result of Step S380 is held NO. When an additional or substitutional member is newly involved in the network system, such a member initially does not have its own path management table. A secondary member having no receiver port may not execute Steps of S380–S410 as enclosed by the dashed line in the figure. More concrete description of the logical path setting is given in the co-pending U.S. patent application Ser. No. 08/388,982.

Figure 10:
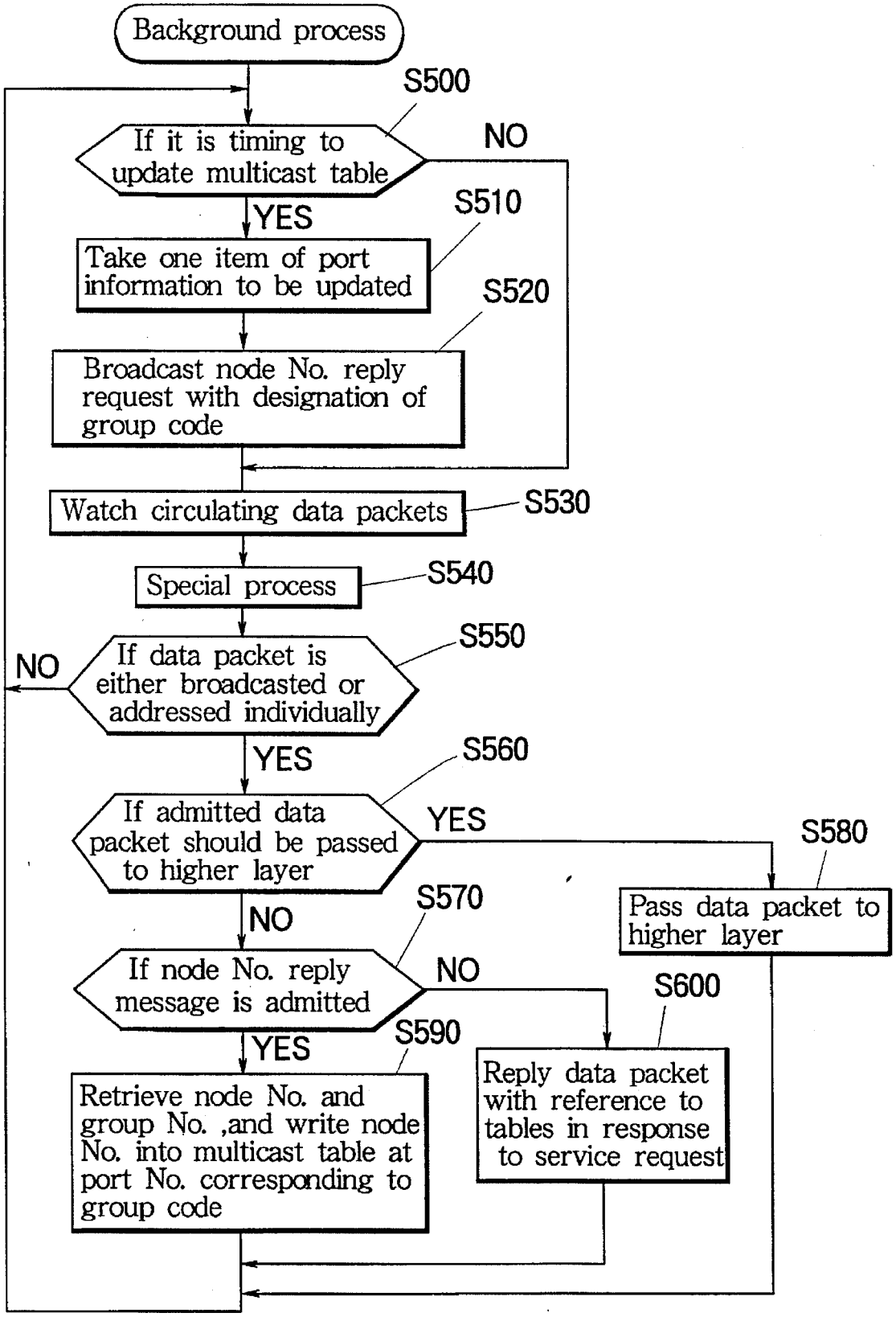
FIG. 10 is a flowchart showing a background process in the network system.

As mentioned before, the background process of the network is commenced in Step S310 of the network initialization routine shown in FIG. 4. The background process is conducted to execute jobs which can be handled in the background separately from upper layer jobs related to the musical instrument. As shown in FIG. 10, when the background process is called, Step S500 is undertaken to check as to if it is a timing to update a multicast table which is used to enable one node to recognize which of other nodes receives a message transmitted from each port of the one node. If it is judged that the updating timing is coming, Step S510 is undertaken to select one port number to be updated from the port information table in order to make the multicast table. Then, Step S520 is undertaken to designate a group code and to broadcast a request to reply a node number of counterpart members.

FIG. 6 shows an example Of the multicast table which is installed in the sequencer node. The table indicates that the transmitter port *17 is connected to counterpart nodes 4, 7, 8 and 12, the transmitter port *18 is connected to counterpart nodes 5, 9, 15 and 18, and the transmitter port *19 is connected to counterpart nodes 6 and 10. It should be noted that FIG. 1 shows the nodes 1–6, and further nodes 7–18 are not shown in FIG. 1. The group code is listed in the port information table shown in FIG. 7. The group code, for example, "10" is attached to a data packet to be transmitted from the port *17. This packet is received by the node 4, i.e., the first tone generator having a receiver port assigned with the group code "10". In the FIG. 7 table, the mark "d" indicates that the corresponding port has a blank group code or an ineffective group code.

After finishing Step S520, Step S530 is undertaken to watch circulating data packets. Step S540 is undertaken to carry out a special process. In this process, the initiative member designated to the supervisory member collects all the node numbers and the associated node unique information. However, other node members than the initiative member may not execute this special process. Further, Step S550 is undertaken such that the individual member checks as to if the circulating data packet is either broadcasted and addressed thereto. In case of YES, subsequent Step S560 is undertaken to check as to if the admitted data packet should be passed to a higher layer. If it is judged that the admitted packet is other than those passed to the higher layer such as tone generation data packets, subsequent check is made in Step S570 as to if the received packet is a reply message of node number. If YES, Step S590 is undertaken to retrieve a node number and a group code from the packet. Further, a port number corresponding to the group code is searched with reference to the port information table. The node number is written into a row of the multicast table corresponding to the searched port number to thereby make the multicast table. In case of NO, subsequent Step S600 is undertaken such that the node member issues a reply data packet concerning itself with reference to various installed tables in response to a service demand contained in the received data packet. Particularly, the node member transmits a reply data packet in response to an inquiry demand concerning the port type for use in settings of logical paths, a reply data packet in response to a user request for the port information table, a reply message packet in response to a confirmation request, or a reply message packet of receipt acknowledgement. On the other hand, if the check result of Step S560 is found YES, Step S580 is undertaken to pass the received data packet to the higher layer. Further, if the check result of Step S550 is found NO, the process backs to Step S500 as in the case where Step S580, S590 or S600 is finished, thereby repeating the aforementioned background process. By such a manner, the multicast table is completed as shown in FIG. 6. Musical equipments constituting the nodes are not so frequently changed, hence the updating timing of the broadcast table may have a sufficiently long period.

Figure 11:
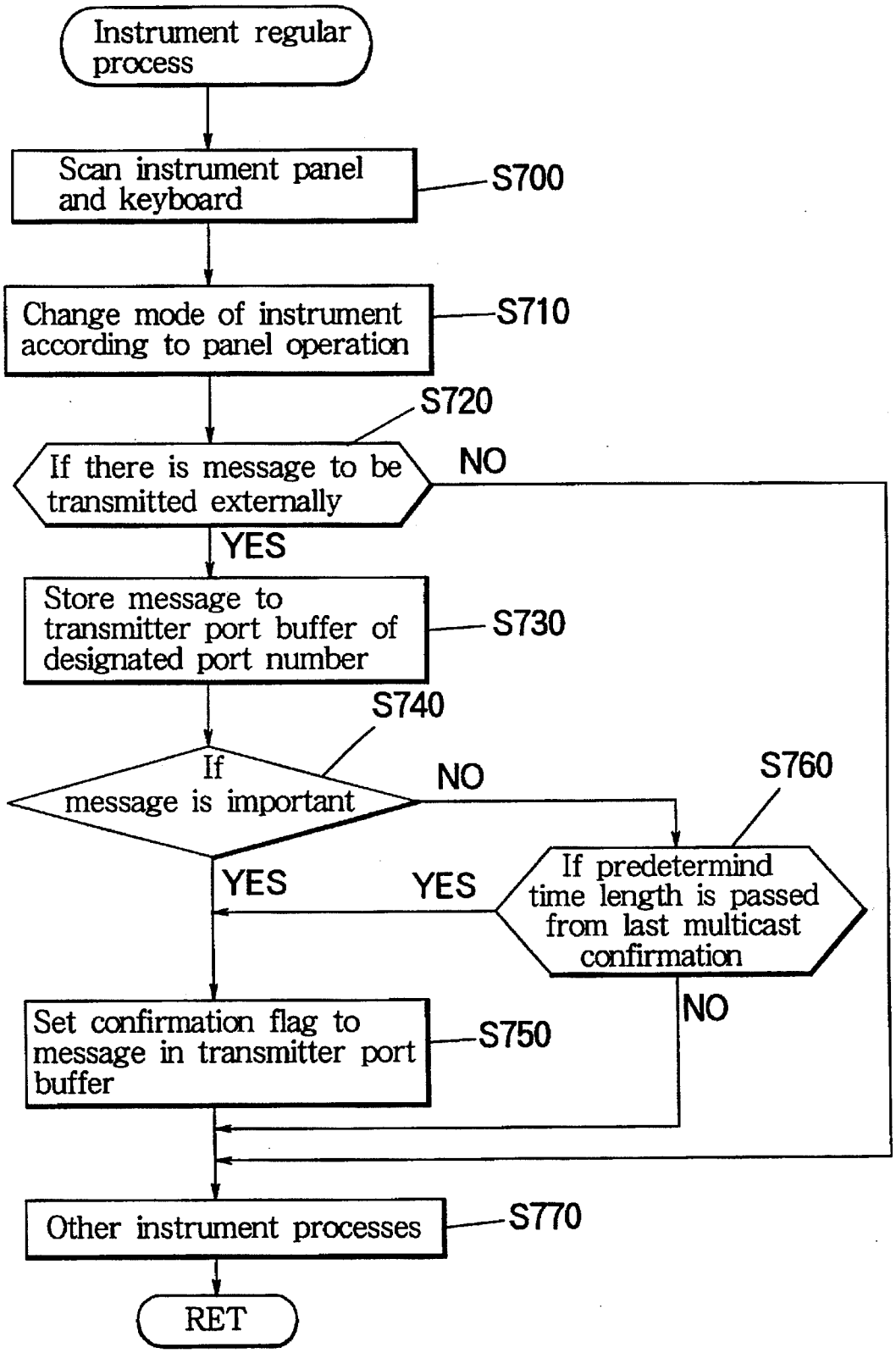
FIG. 11 is a flowchart showing an instrument regular process.

Next, FIG. 11 is a flowchart showing detail of the instrument regular process executed at Step S170 of the main routine shown in FIG. 2. The instrument regular process is started so that an instrument panel and a keyboard are scanned at Step S700 to detect operation of the panel and play of the keyboard. Then, a mode of the electronic instrument is changed according to the panel operation in Step S710. Further, check is made in Step S720 as to if external transmission of a message is required in response to key-on of the keyboard or start operation of the sequencer or the like. If YES, a port number is designated and the message is stored in the transmitter port buffer in Step S730. By this, a lower layer of the application program works to transmit the message stored in the buffer.

Further, check is made in Step S740 as to whether the message or data stored in the transmitter port buffer is important or unimportant. If important, a confirmation flag is set to the message of the buffer in Step S750. If unimportant, check is made at Step S760 as to if a predetermined time length lapses after the last multicast confirmation or acknowledgement. If YES, Step S750 is undertaken to set the confirmation flag to the message in the buffer in similar manner. By this, the confirmation flag is broadcasted after each predetermined time length to periodically examine if counterpart nodes properly respond. Lastly, other instrument processes are carried out in Step S770. Step S770 is also carried out if Step S760 judges that the predetermined time length does not yet lapse, or if Step S720 judges that the external message transmission is not necessary. Thereafter, the routine returns.

FIG. 18 shows a list of various control messages and reply messages. The important messages are marked by a circle, and unimportant messages are marked by a cross. Those messages "KOFF", "TONE change" and "ALL NOTE OFF" are important, and therefore transmitted together with the confirmation flag.

Figure 12:
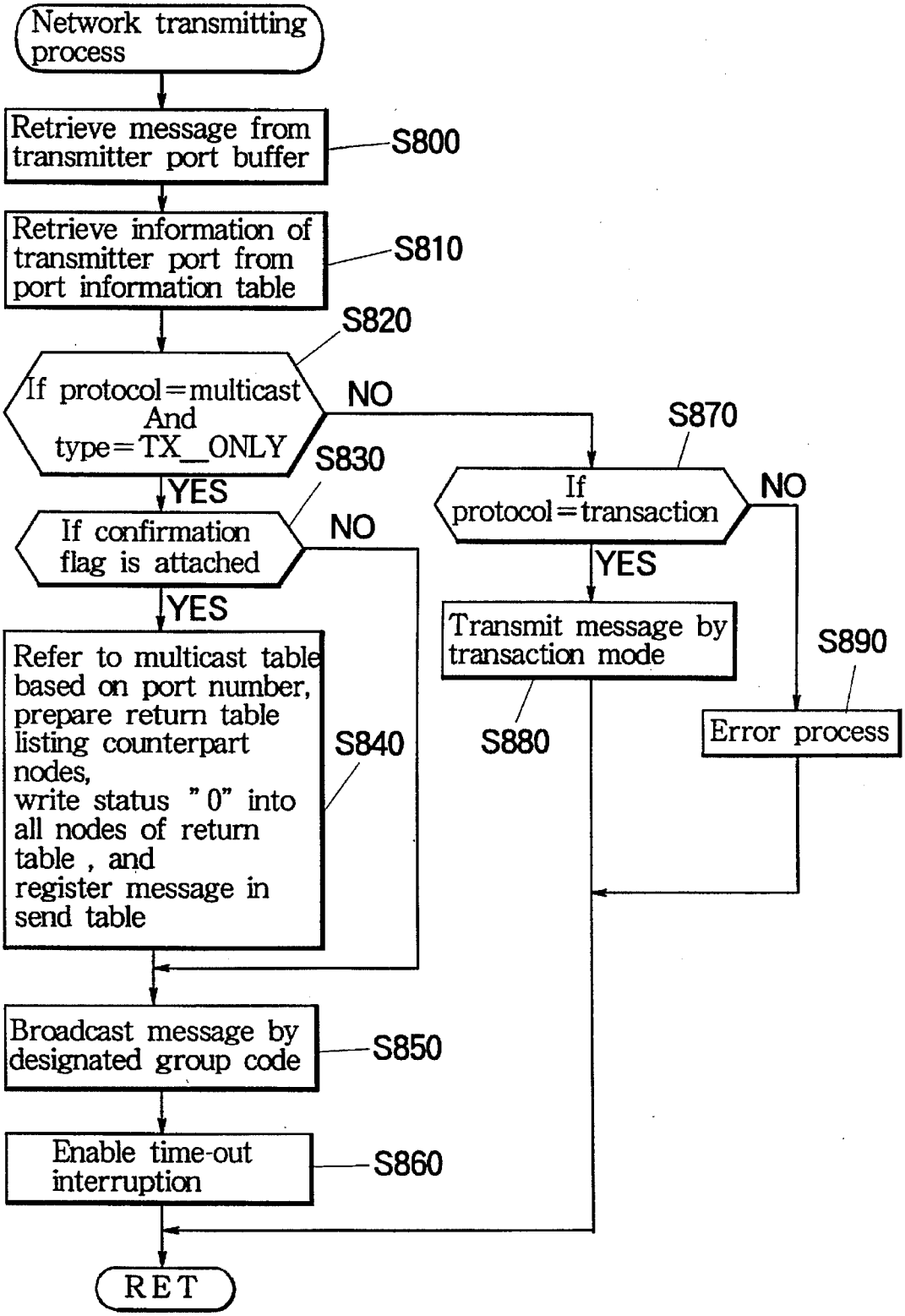
FIG. 12 is a flowchart showing a network transmitting process.

FIG. 12 is a flowchart showing detail of the network transmitting process executed in Step S180 of the main routine shown in FIG. 2. This transmitting process is carried out to transmit the message which is stored in the transmitter port buffer by the preceding instrument regular process. When the network transmitting process is started, the message is retrieved from the buffer at Step S800. Then, information related to an attending transmitter port is retrieved from the port information table. Since the message cannot be transmitted by the port number, the group code assigned to the port number is retrieved in reference to the FIG. 7 port information table. Then, check is made at Step S820 as to if "protocol" is "multicast" and "type" is "TX_ ONLY". If YES, subsequent check is made at Step S830 as to if the confirmation flag exists. The item "protocol" is indicated in the port information table. The item "type" indicates whether the port functions as a transmitter alone, a receiver alone, or a transmitter/receiver. The item "TX_ ONLY" indicates that the port functions only as the transmitter.

If it is judged by Step S830 that the stored message is accompanied by the confirmation flag, a return table is prepared for the counterpart nodes by Step S840 according to the port number and the multicast table. All spaces of the return table are filled with "0" which indicates a waiting state for a reply message. Further, the message to be transmitted is registered into a send table.

FIG. 17A shows an example of the send table in which the message "ALL NOTE OFF" is registered for the attending port *17. This means that the message "ALL NOTE OFF" is transmitted from the port *17. FIG. 17B shows an example of the return table in which a column of "status" is initially written with status "0" to wait for reply messages. The return table shown in FIG. 17B is a completed form after receipt of the reply messages.

Referring back to FIG. 12, the message is broadcasted with the designated group code at Step S850. Subsequently, a time-out interruption routine is enabled at Step S860. By this, a timer runs to wait for a reply message for a predetermined time interval.

On the other hand, if Step S820 judges that the condition "protocol"="multicast" and "type"="TX_ONLY" is not met, subsequent check is made at Step S870 as to if "protocol"="transaction". If YES, the message is transmitted by a transaction mode at Step S880, thereby returning. The item "transaction" indicates the message communication between a pair of nodes which are mutually recognized by each other. If the judgement of Step S870 is negative, an error process is executed in Step S890, thereby returning. This error process is different from an error recovery process as will be described later.

Figure 13:
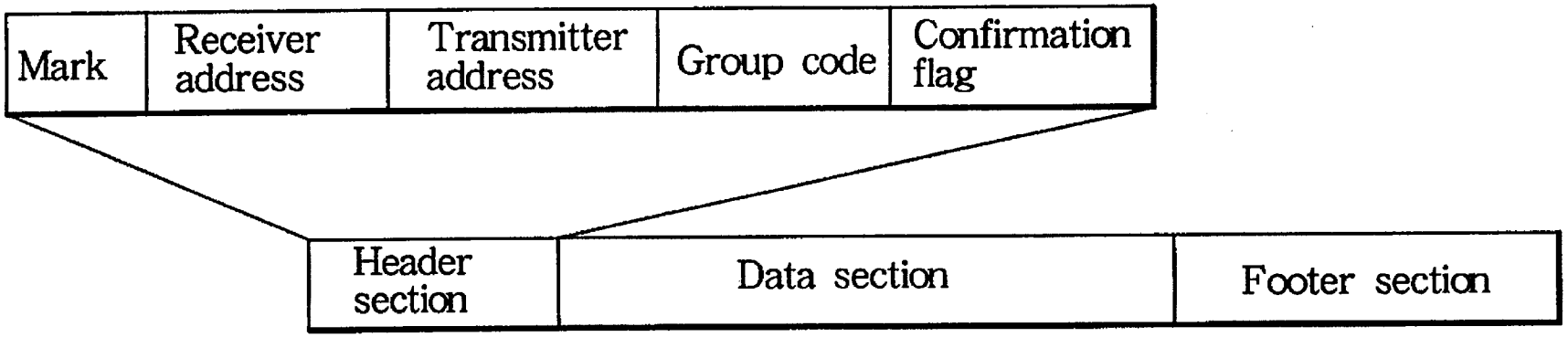
FIG. 13 shows a data packet format.

FIG. 13 shows a format of the data packet which is circulated through the network. The packet is composed of a header section, a data section and a footer section. The header section contains a mark or a start address, a receiver address such as a broadcast address, a transmitter address, a group code which indicates the multicast, and a confirmation flag which is attached if the message or data is important. The data section contains a message to be transmitted. The footer section contains an error correction code and an end mark.

Figure 14:
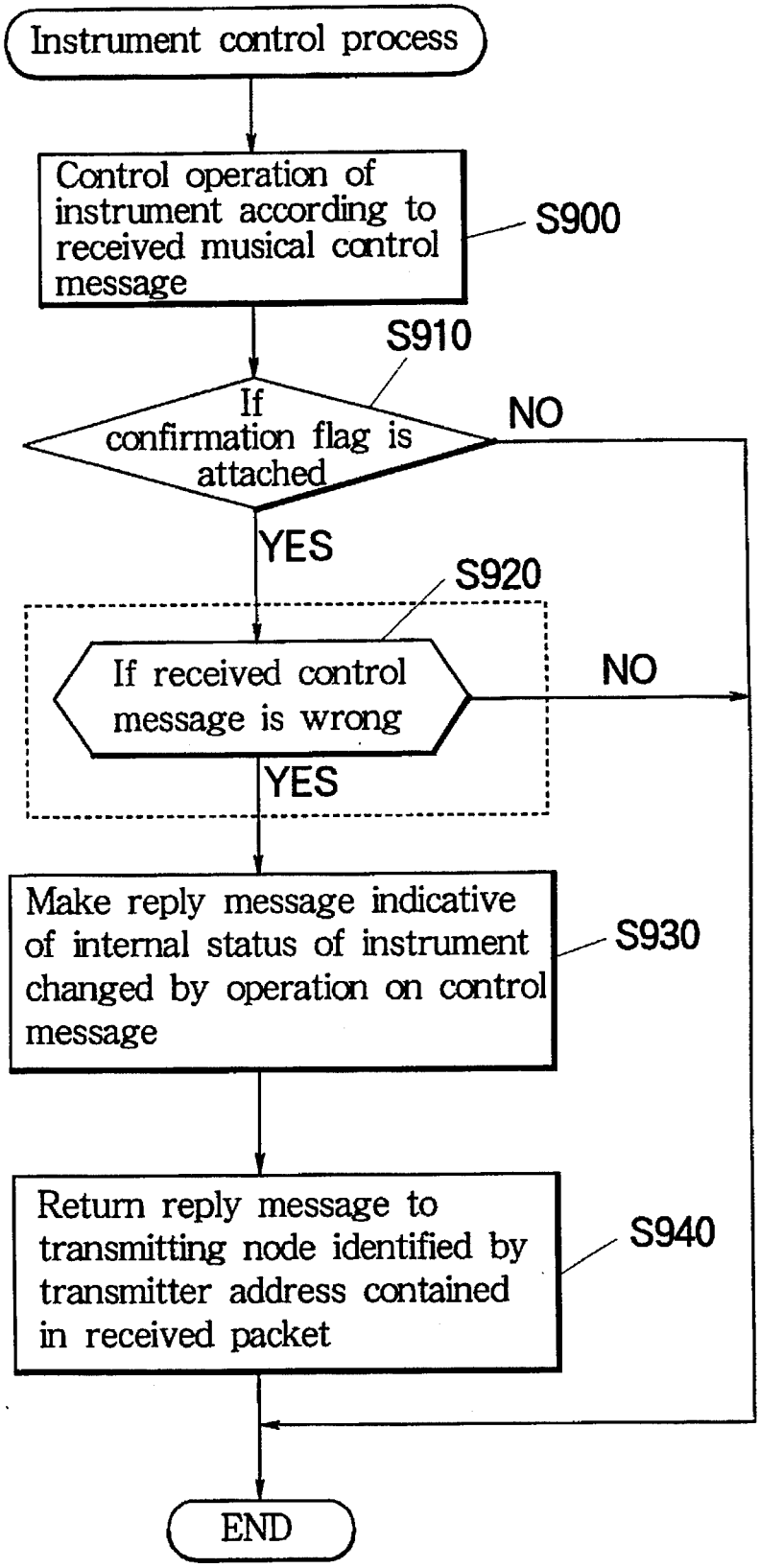
FIG. 14 is a flowchart showing an instrument control process.

Next, FIG. 14 is a flowchart showing detail of the instrument control process which is executed in Step S150 of the main routine shown in FIG. 2. When the instrument control process is commenced, operation of the electronic musical instrument node is Controlled by Step S900 according to a received control message such as a key-on message and a key-off message. Then, check is made at Step S910 as to if the confirmation flag is attached to the message. If YES, subsequent check is made at Step S920 as to whether the received musical control message is adequate or inadequate, i.e., right or wrong. If wrong, Step S930 is undertaken to make a reply message containing status information which indicates a current internal status of the instrument, changed as a consequence of operation on the received control message. For example, the reply message may indicate an error that the instrument has failed to assign a received musical key code data. Otherwise, the reply message may indicate an error that the instrument has inadvertently assigned the received musical key code data. Further, the reply message is returned by Step S940 to a transmitting node which is identified by the transmitter address contained in the received packet. Thereafter, the routine returns. If Step S920 judges that the received message is right or if Step S910 judges that the received message is not accompanied by the confirmation flag which serves as a request command to request an error check, the routine also returns.

By such a manner, Step S920 is added as indicated by the dashed line so that the reply message or error message is returned only if the received musical message is wrong to disturb the operation, i.e., only if an error is found. In such a construction, the transmitting node can confirm as to if the receiving node has correctly received the message without substantial increase in communication traffic. However, the multicast table is not used in this construction. Alternatively, Step S920 may be omitted so that the receiving node returns the confirmation reply whenever the received message is accompanied by the confirmation flag. The transmitting node can recognize that the receiving node has adequately received the message and has adequately operated on the received message. Namely, the return table is formed and filled using the multicast table as will be described later.

Figure 15:
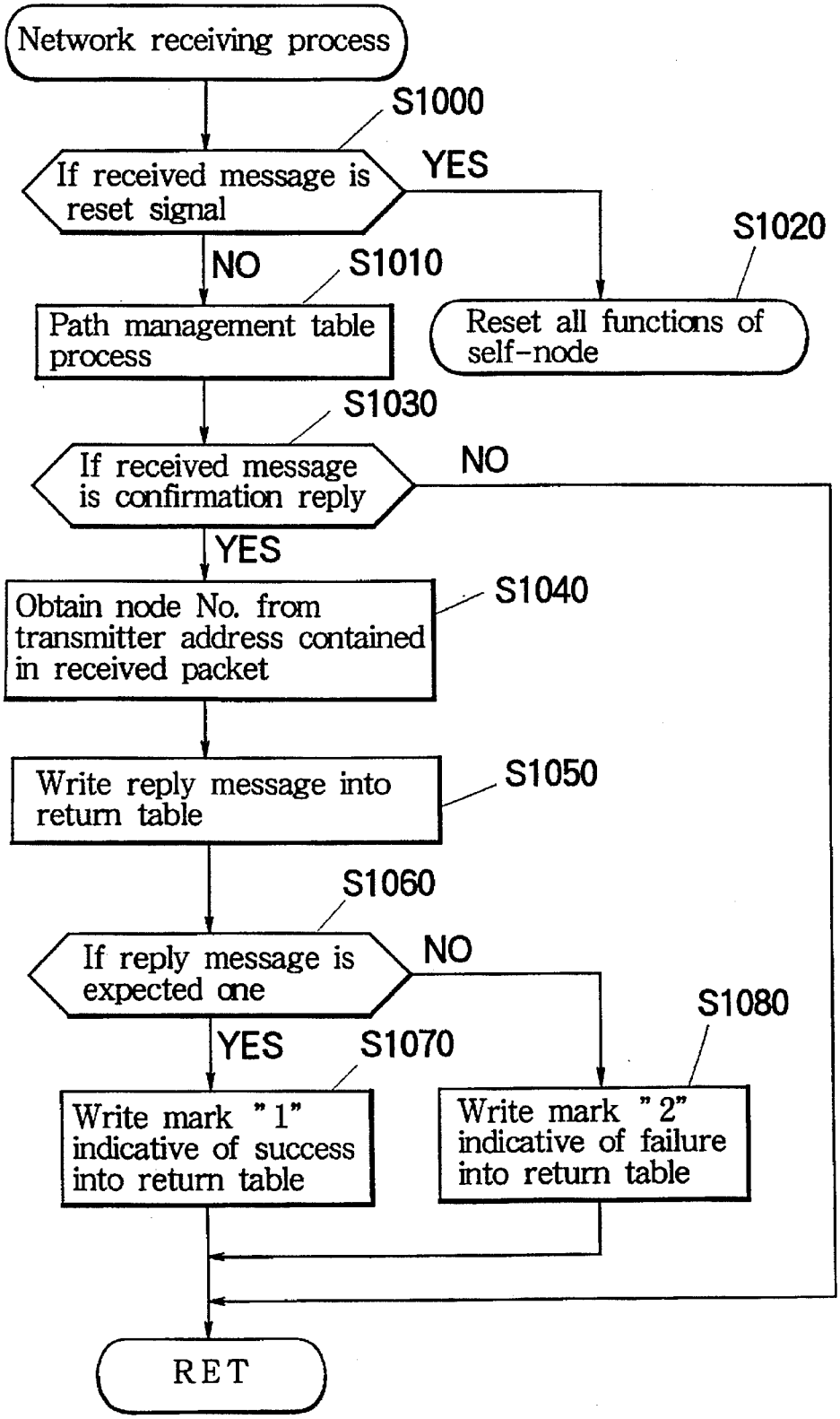
FIG. 15 is a flowchart showing a network receiving process.

Next, FIG. 15 is a flowchart showing detail of the network receiving process executed in Step S140 of the main routine shown in FIG. 2. When the network receiving process is started, check is made in Step S1000 as to if the message received from the communication network indicates a reset signal. If YES, the receiving node resets all of its own operations. This reset signal is issued to reset the network system when a new node is connected to the network. As described before, each node runs the application program and the port program independently and separately from each other. Thus, it may be possible to reset the port program alone. However, if the reset signal is issued from a far end node of the network, the reset signal may collide with messages issued from other nodes to thereby cause abnormal sound generation or destructive running. In view of this, each node resets all of its own functions. On the other hand, if it is judged that the received message is not the reset signal, a path management table process is executed in Step S1010. This process is carried out to construct the logical paths according to the path management table stored in a floppy disk or the like.

Next, check is made in Step S1030 as to if the received message is a reply message or an acknowledgement. If YES, a node number of the transmitting node is identified at Step S1040 according to a transmitter address contained in the received packet of the reply message with reference to the node table and others. Further, the reply message is written by Step S1050 into the return table which is prepared in the previous network transmitting process. Then, check is made in Step S1060 as to if the reply message is an expected one. If the reply message is the expected normal one, a mark "1" is written by Step S1070 into a corresponding space of the return table to thereby indicate "success". On the other hand, if the received reply message is not an expected one, but an abnormal one indicative of mis-operation of the responding node, a mark "2" is written by Step S1080 into a corresponding space of the return table to thereby indicate "failure".

FIG. 18 shows examples of the control messages and the reply messages. In the table, if the control message "KON" is forwarded, an expected normal reply message should be "assigned" which indicates that a key-on note specified by "KON" is safely assigned to a tone generating channel. On the other hand, an unexpected abnormal reply message, i.e., an error message may be "no assign channel" which indicates that the node mis-operates or fails to assign the key-on note. If the control message "ALL NOTE OFF" is broadcasted, an expected normal reply message should be "stopped" which indicates that the responding node has stopped the tone generation. An unexpected abnormal reply message may be "what?" which indicates that the responding node cannot understand the control message. For example, if the control message "ALL NOTE OFF" is inadvertently transmitted to a node having a performance implement such as a keyboard due to erroneous connection of the network, this node could not understand the control message. By such a manner, the status space of the return table is filled with the marks "1" or "2" for the responding nodes according to the check results of the respective reply messages to thereby complete the return table as shown in FIG. 17B. Non-responding nodes remain in the mark "0".

Figure 16:
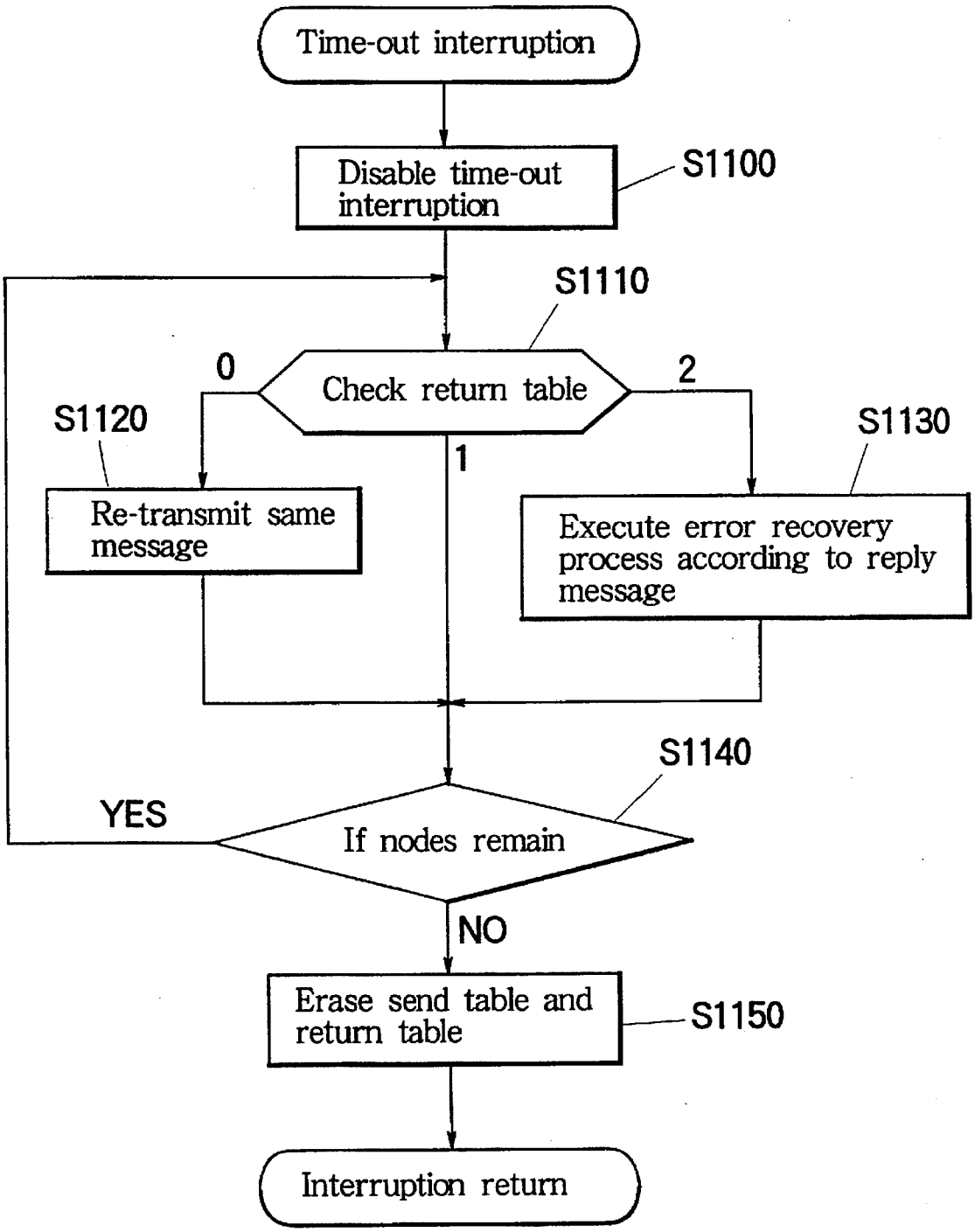
FIG. 16 is a flowchart showing a time-out interruption process.

Lastly, FIG. 16 shows the time-out interruption routine which is executed to recover the abnormal status of the responding node marked by "2" indicative of the failure. This time-out interruption routine is enabled at Step S860 in the network transmitting process. This routine is called when the timer counts a predetermined time interval. Firstly, the time-out interruption is disabled at Step S1100 to ensure a single interruption. Then, the status information is retrieved from the return table at Step S1110 to judge what the status information means. In case of the status "1", the routine directly proceeds to Step S1140 since no abnormality has occurred. In case of the status "2", a suitable error recovery process is executed by Step S1130 according to the received abnormal reply message, thereby advancing to Step S1140. In case of "0" which indicates no response, the same control message is again transmitted to the non-responding node by Step S1120, thereby advancing to Step S1140.

The table of FIG. 18 lists various error recovery processes executed by Step S1130. For example, if an abnormal message "no KON data" is returned in response to a control message "KOFF", the error recovery process is to simply ignore the reply message "no KON data". If an abnormal message "what?" is returned in response to a control message "ALL NOTE OFF", the error recovery process is to reset the network after confirmation by a user since the network suffers from erroneous path connection. Then, check is made in Step S1140 as to if the return table contains a responding node which is not yet treated. If YES, the routine returns to Step S1110 to repeat the cycle of Steps S1110–S1140 until all of the nodes are treated. Then, the judgement of Step S1140 turns to NO, and the send table and the return table are erased at Step S1150. Thereafter, the interruption routine returns to the main routine.

As described above, according to the first aspect of the present invention, when one node concurrently transmits a musical control message to other nodes by multicast through the communication network, each node returns an error message only if the received message is a wrong one. Preferably, the error message is returned only when the received musical control message is important. Further, preferably, the transmitting node periodically checks if counterpart nodes safely receive the message under the multicast mode. According to the second aspect of the present invention, the transmitting node prepares a list of counterpart nodes of the multicast which receive a common transmitted message. Further, a confirmation flag is added to discriminate an important message, or to investigate if the network is correctly connected. When the counterpart node receives the confirmation flag, the counterpart node returns a reply message containing status information indicative of status change as a consequence of the received message to the transmitting node. The transmitting node registers the status information which is returned from the respective counterpart nodes in the return table. The return table is investigated to enable the error recovery treatment for a counterpart node which has not returned an expected reply message. In this case, preferably, the transmitting node may periodically check at each time interval as to which of the counterpart nodes of the multicast receives the transmitted message. In this second aspect, each node has a sufficiently fast computation speed. Therefore, two or more of the send tables and the return tables are never prepared, but a sequence of the reply confirmation process and the error recovery process is finished within the musical sound generation process. Therefore, the reply confirmation and error recovery process may not affect other processes. The disclosed embodiments are directed to the network system of electronic musical instruments. However, the present invention is not limited to the network system of the electronic musical instruments, but may be applied to a general network system which involves various consumer electronic equipments such as a television set, a video tape recorder, an audio component and a karaoke apparatus.

As described above, according to the invention, when a receiving node receives a wrong control message, the receiving node returns a reply message to notify that fact to a transmitting node. Therefore, the transmitting node can recognize an error of the control message or another error of path connection. The reply message is returned only when the wrong message is received, thereby avoiding increase in communication traffic. Further, the receiving node returns status information indicative of its own status change as a result of the receipt of the control message. Therefore, the transmitting node can confirm not only that the control message reaches the receiving node but also that the receiving node executes operation as expected by the transmitting node. Further, a reply message is requested only for important messages to save the communication traffic. In this case, the network system dynamically checks the membership of the multicast nodes to timely follow addition or removal of nodes. Further, the error recovery process is executed differently for a node which suffers from communication troubles and for another node which suffers from disorder of communication paths.

What is claimed is:

1. A musical network system comprising a plurality of musical equipments interconnected to each other through a communication network which circulates a control message for producing a musical sound, the system further comprising:

a first musical equipment comprising transmitter means for transmitting a control message to the communication network; and a second musical equipment comprising receiver means for receiving the control message from the communication network, generator means operative according to the received control message for producing a musical sound, detector means for detecting whether the received control message is a right one which may not disturb operation of the generator means or a wrong one which may disturb operation of the generator means, and reply means for returning an error message to said first musical equipment through the communication network when the detector means detects that the received control message is the wrong one.

2. A musical network system comprising a plurality of musical equipments interconnected to each other through a communication network which circulates a musical message for producing a musical sound, the system further comprising:

a first musical equipment comprising transmitter means for transmitting to the communication network musical messages which are classified into either of an important type and an unimportant type, and adder means operative only when a musical message of the important type is transmitted for adding thereto a request command effective to request an error check; and a second musical equipment comprising receiver means for receiving a musical message from the communication network, and check means operative when the received musical message is accompanied by the request command for checking if the received musical message contains an error.

3. A musical network system according to claim 2, wherein said first musical equipment further comprises means operative only when a predetermined time length is passed for attaching to a musical message of the unimportant type a request command effective to request said second musical equipment to check an error of the musical message.

4. A musical network system comprising a plurality of musical equipments interconnected to each other through a communication network which circulates a musical message for producing a musical sound, the system further comprising:

a first musical equipment comprising receiver means for receiving a musical message from the communication network, operator means for operating on the received musical message, and reply means for returning to the communication network status information which indicates a current status as a consequence of operation by the operator means; and a second musical equipment comprising transmitter means for transmitting to the communication network the musical message which is received by said first musical equipment, receiving means for receiving from the communication network the status information which is returned by said first musical equipment, detector means for checking the returned status information to detect if mis-operation of the operator means has occurred in said first musical equipment, and recovery means for initiating recovery of the mis-operation.

5. A musical network system according to claim 4, wherein said second musical equipment further comprises means for recovering the mis-operation according to the received status information.

6. A musical network system according to claim 4, wherein said second musical equipment further comprises means operative when said first musical equipment does not return the status information within a predetermined time interval for re-transmitting the same musical message to the communication network.

7. A musical network system comprising a plurality of musical equipments interconnected to each other through a communication network which circulates a musical message for producing a musical sound, the system further comprising:

a first musical equipment comprising transmitter means for transmitting a musical message to the communication network; and a second musical equipment comprising receiver means for receiving the musical message from the communication network, operator means for operating on the received musical message, and transmitter means for transmitting to the communication network status information which notifies change of a status as a consequence of operation by the operator means.

* * * * *